United States Patent [19]

Ando et al.

[11] 4,417,901

[45] Nov. 29, 1983

[54] MIXED FUEL OF COAL AND OIL

[75] Inventors: Takashi Ando; Naoki Oka, both of Sodegaura, Japan

[73] Assignee: Idemitsu Kosan Co., Ltd., Tokyo, Japan

[21] Appl. No.: 372,700

[22] Filed: Apr. 28, 1982

[30] Foreign Application Priority Data

May 8, 1981 [JP] Japan ..... 56-68182

[51] Int. Cl.[3] ..... C10L 1/32

[52] U.S. Cl. ..... 44/51; 406/47; 406/49

[58] Field of Search ..... 44/51; 406/47, 49

[56] References Cited

U.S. PATENT DOCUMENTS 2,231,513 2/1941 Stillman ..... 44/51

FOREIGN PATENT DOCUMENTS 54-40808 3/1979 Japan ..... 44/51

*Primary Examiner*—Thomas A. Waltz

*Assistant Examiner*—Margaret B. Medley

*Attorney, Agent, or Firm*—Frishauf, Holtz, Goodman & Woodward

[57] ABSTRACT

A mixed fuel of coal and oil in the form of a dispersion of coal particles in oil. The coal particles comprise coal particles (A) having a median diameter of 10 microns or less together with coal particles (B) having a median diameter of between 15 and 42 microns. The ratio of coal particles (A) to coal particles (B) is from 8:2 to 1:9. The absolute value of the difference between the median diameter and the modal diameter of all the coal particles in the mixed fuel of coal and oil is at least 2 microns. The mixed fuel preferably has a water content of 0.6% by weight or less.

11 Claims, No Drawings

MIXED FUEL OF COAL AND OIL

BACKGROUND OF THE INVENTION

The present invention relates to a mixed fuel of coal and oil, and more particularly, to a mixed fuel of coal and oil of low viscosity and high stability in which coal grains having a specific grain size distribution are used.

It has heretofore been believed that in order to stably disperse coal grains in a hydrocarbon oil without the use of surface active agents, the coal should be pulverized to a fineness of about 10 microns or less. When such fine coal grains are dispersed in oil, the viscosity of the resulting mixture increases greatly. The coal grains do not substantially settle and are maintained stably dispersed even when the mixture stands for a period of more than one month. This, therefore, gives rise to the problem that the coal content cannot be increased since if the coal content is increased, difficulties are encountered in transporting and burning the resulting fuel. In general, it is preferable for practical use that the viscosity (70° C.) of the mixed fuel of coal and oil is less than 60 poises.

In order to obviate the above problems, Japanese Patent Application Laid-Open No. 40808/1979 disclosed a method in which hydrocarbon oil is mixed with coal grains having a grain size distribution in which there are two peaks. The method, however, is not satisfactory in that the static stability (resistance to settling) of the mixed fuel is insufficient.

SUMMARY OF THE INVENTION

The object of the invention is to provide a mixed fuel of coal and oil which has low viscosity and high static stability even when the mixture has a large coal content.

It has been found that the object is attained by controlling the grain size distribution of coal grains and at the same time, by choosing coal grains so that the median diameter and the modal diameter thereof have a specific relation with each other.

The present invention, therefore, provides a mixed fuel of coal dispersed in oil which comprises from 40 to 60 percent by weight of finely ground coal and from 60 to 40 percent by weight of a hydrocarbon oil, said finely ground coal being a mixture of (A) coal grains having a median diameter of 10 microns or less and (B) coal grains having a median diameter of from 15 to 42 microns in a ratio A/B of from 8/2 to 1/9; and the absolute value of the difference between the median diameter and the modal diameter of the coal grains in said mixture being at least 2 microns.

DETAILED DESCRIPTION OF THE INVENTION

The coal for use in the mixed fuel of the invention is not limited, and various kinds of coals can be used, including lignite, brown coal, bituminous coal, and smokeless coal. The coal is not necessarily of high quality. Usually, from an economic viewpoint, brown coal or bituminous coal is used.

The coal is finely pulverized and, thereafter, is used in the mixed fuel of the invention. The mixed fuel of the invention is characterized by the use of coal grains having a specific grain size distribution. In accordance with the invention, (A) super fine coal grains having a median diameter of 10 microns or less, preferably from 5 to 10 microns, and (B) fine coal grains having a median diameter of from 15 to 42 microns, preferably from 15 to 30 microns, are used in a ratio (by weight) of 8/2 to 1/9. It is particularly preferred to use super fine coal grains and fine coal grains in a ratio of from 7/3 to 2/8. When the proportion of (A) super fine coal grains having a median diameter of 10 microns or less is too large, the viscosity of the mixed fuel increases to an undesired high value. On the other hand, when the proportion of (B) fine coal grains having a median diameter of from 15 to 42 microns is too large, the static stability of the mixed fuel is decreased.

With regard to the grain size distribution of coal as herein used, in addition to the above-described requirement, it is further required that the absolute value of the difference between the median diameter (the value in an ordered set of quantities below and above which fall an equal number of quantities) and the modal diameter (the value that occurs most frequently) of the coal grains of a mixture of (A) and (B) should be at least 2 microns. When the absolute value of the difference between the median diameter and the modal diameter is less than 2 microns, there will be almost no improvement in the viscosity compared with conventional mixed fuels when the coal content is high. And thus, the effect of reducing the viscosity cannot be obtained to the desired extent.

Any hydrocarbon oil can be used in the invention as long as it is liquid at ordinary temperature and is capable of dispersing therein fine particles (grains) of coal. Examples include petroleum-based fuel oils and coal-based fuel oils, e.g., crude oil, topped crude oil, kerosine, light oil, heavy oil A, heavy oil B, heavy oil C, vacuum-distillation residue, residual crude oil, and tar oil and creosote oil.

The coal content of the mixed fuel of the invention can be changed within a wide range, from a low level to a high level. From an economic viewpoint, it is preferred to prepare the mixed fuel having a high coal content within the range that problems are not encountered in handling and transportation. In the mixed fuel of the invention, even if the coal content is increased, no significant increase in the viscosity is observed, and the static stability can be held within a practical range since, as described hereinbefore, coal grains having a specific grain size distribution are used. In accordance with the invention, the coal content, therefore, can be increased to higher levels compared with the conventional mixed fuels. Usually the coal content is from 40 to 60%, preferably from 45 to 55%, based on the weight of the mixed fuel.

The mixed fuel of the invention can be prepared either by a method in which the fine coal grains having a grain size distribution satisfying the above-described requirements are added to a hydrocarbon oil and mixed by stirring, or a method in which crude coal grains are added to a hydrocarbon oil and mixed by stirring while pulverizing the crude coal grains into finer coal grains. In addition, two or more mixed fuels having different coal grain size distributions can be mixed appropriately to prepare a mixed fuel having the desired coal content and grain size distribution.

It is preferred for the mixed fuel of the invention to have a water content of 0.6% by weight or less. The water content of the mixed fuel can be controlled within the above range by various techniques. For example, coal is subjected to coarse pulverization, during or after which hot air is blown over the coal to adjust the water content thereof and, thereafter, a suitable amount of hydrocarbon oil is added to the coarsely pulverized coal and they are mixed together, and the resulting mixture is subjected to super fine pulverization by means of a ball mill, a stirring type ball or the like to prepare the desired mixed fuel. In accordance with another method, coal is coarsely pulverized, and a suitable amount of hydrocarbon oil is added thereto and mixed. In this case, it is preferred to use a hydrocarbon oil which first has been heated to at least 100° C. Thereafter, the coal in the mixture is subjected to super fine pulverization during which the coal grains are dehydrated by the heated oil. Thus, a mixed fuel having a water content of 0.6% by weight or less is obtained.

The mixed fuel of the invention is excellent in static stability even though no surface active agent is used, and furthermore, since the viscosity of the mixed fuel is relatively low even at high coal content, the mixed fuel is convenient to handle in transportation and combustion. The mixed fuel of the invention, therefore, offers the advantages that it can be effectively utilized in various uses, e.g., production of electric power, and that it can be utilized as the optimum form for the transportation of coal.

The following examples and comparative examples are given to illustrate the invention in greater detail.

COMPARATIVE EXAMPLES 1 to 8

Finely-ground coal (Taiheiyo coal), 80% by weight of which passed through a 200-mesh sieve, and residual crude oil (viscosity: 54.3 centistokes/75° C.) were mixed in various ratios and pulverized in a wet-type ball mill (Dynomill produced by Willy A. Bachofen Engineering Works). Each mixed fuel thus prepared was allowed to stand for the purpose of evaluation of static stability, and furthermore, the coal content, the grain size distribution and the viscosity were measured.

The results are shown in Table 1.

The measurement of the grain size distribution and viscosity, and the evaluation of the static stability were performed as follows:

Grain Size Distribution

In a 300-milliliters beaker was placed 1.0 gram of the mixed fuel which was then washed twice with 200 milliliters of toluene by decantation to remove the residual crude oil from the mixed fuel. Then 0.1 gram of the coal particles obtained were mixed with 100 milliliters of a 2% sodium chloride (NaCl) solution to convert it into a slurry-like form, and the grain size distribution was measured with a Coulter counter (produced by Nippon Kagaku Kikai Co., Ltd.). From this grain size distribution were determined the median diameter and the modal diameter.

Viscosity

The viscosity was measured with a coaxial cylinder rheometer (Model L-II Rheometer, produced by Iwamoto Seisaku Co., Ltd.).

Static Stability

Into a cylindrical tube, made of stainless steel 250 millimeters long and an inner diameter of 27 millimeters, and equipped with a cap (the volume of which was 5% of the total volume) at the bottom, was introduced 150 milliliters of the mixed fuel which was then allowed to stand at 70° C. After a predetermined period of time, the cap was removed, and the coal content of the mixed fuel in the cap was measured to determine the static stability (settling characteristics).

TABLE 1

| Comparative Example No. | Median Diameter (microns) | Modal Diameter (microns) | Absolute Value of Difference between Median Diameter and Modal Diameter (microns) | Coal Content (%) | Viscosity (poises/ 70° C.) | Static Stability (%) After 15 days | Static Stability (%) After 30 days |
|---|---|---|---|---|---|---|---|
| 1 | 7.5 | 6.1 | 1.4 | 43 | ≧100 | 43 | 43 |
| 2 | 15.0 | 14.7 | 0.3 | 45 | 80 | 45 | 45 |
| 3 | 17.2 | 16.9 | 0.3 | 46 | 35 | 63 | * |
| 4 | 25.0 | 26.0 | 1.0 | 46 | 22 | * | * |
| 5 | 28.6 | 28.7 | 0.1 | 47 | 25 | * | * |
| 6 | 3.0 | 2.8 | 0.2 | 45 | ≧100 | 45 | 45 |
| 7 | 60.0 | 59.7 | 0.3 | 45 | 5 | * | * |
| 8** | 55.0 | 38.0 | 17.0 | 45 | 20 | 60 | — |

*Complete separation of coal from oil occurred.
**A mixed fuel prepared by mixing the mixed fuel of Comparative Example 6 and the mixed fuel of Comparative Example 7 in a ratio of 4/6 was used.

EXAMPLE 1

The mixed fuel of Comparative Example 1 and the mixed fuel of Comparative Example 3 were mixed in a ratio of 7/3 to prepare a mixed fuel. With the thus-prepared mixed fuel, the measurement of the grain size distribution and viscosity, and the evaluation of the static stability were carried out in the same manner as described in Comparative Examples 1 to 8.

The results are shown in Table 2.

EXAMPLE 2

The procedure of Example 1 was repeated with the exception that the mixing ratio was 5/5 instead of 7/3.

The results are shown in Table 2.

EXAMPLE 3

The procedure of Example 1 was repeated with the exception that the mixing ratio was 4/6 instead of 7/3.

The results are shown in Table 2.

EXAMPLE 4

The procedure of Example 1 was repeated with the exception that the mixing ratio was 3/7 instead of 7/3.

The results are shown in Table 2.

EXAMPLE 5

The mixed fuel of Comparative Example 1 and the mixed fuel of Comparative Example 2 were mixed in a ratio of 4/6 to prepare a mixed fuel. With the thus-prepared mixed fuel, the grain size distribution and viscosity were measured, and the static stability was evaluated in the same manner as in Comparative Examples 1 to 8.

The results are shown in Table 2.

EXAMPLE 6

The mixed fuel of Comparative Example 1 and the mixed fuel of Comparative Example 4 were mixed in a ratio of 4/6 to prepare a mixed fuel. With the thus-prepared mixed fuel, the grain size distribution and viscosity were measured, and the static stability was evaluated in the same manner as in Comparative Examples 1 to 8.

The results are shown in Table 2.

TABLE 2

| Example No. | Median Diameter (microns) | Modal Diameter (microns) | Absolute Value of Difference between Median Diameter and Modal Diameter (microns) | Coal Content (%) | Viscosity (poises/ 70° C.) | Static Stability After 15 days | Static Stability After 30 days |
|---|---|---|---|---|---|---|---|
| 1 | 9.9 | 6.3 | 3.6 | 46 | 31 | 46 | — |
| 2 | 12.5 | 16.0 | 3.5 | 46 | 30 | 46 | — |
| 3 | 13.5 | 16.5 | 3.0 | 46 | 25 | 46 | 46 |
| 4 | 14.7 | 16.7 | 2.0 | 46 | 30 | 46 | — |
| 5 | 11.8 | 14.3 | 2.5 | 45 | 36 | 45 | — |
| 6 | 17.5 | 22.8 | 5.3 | 45 | 14 | 53 | — |

EXAMPLES 7 to 14 and COMPARATIVE EXAMPLES 9 to 12

Finely-ground coal I or II, each having the properties shown in Table 3, and heavy oil C from the Middle East having the properties shown in Table 4 were mixed in a ratio of 50/50 (by weight), so that the coal content was 50% by weight, and the resulting mixture was further pulverized in a wet type ball mill (Dynomill, produced by Willy A. Bachofen Engineering Works) to prepare a mixed fuel of coal and oil.

In these examples, coal which was dried with air (Example 13 and 14 and Comparative Examples 9 and 10) and coal which was dried with hot air at 107° C. for 2 hours (Examples 7 to 12 and Comparative Examples 11 and 12) were employed for the purpose of comparison.

Each mixed fuel thus prepared was allowed to stand to evaluate the static stability, and furthermore, the grain size distribution, water content and viscosity were measured.

The results are shown in Table 5.

TABLE 3

| Type of Coal | Technical Analysis (wt %) Fixed Carbon | Water Content | Ash Content | Volatile Content | Calorific Value Kcal/kg |
|---|---|---|---|---|---|
| I | 42.0 | 5.8 | 9.7 | 42.5 | — |
| II | 45.9 | 9.4 | 9.4 | 35.3 | 5980 |

TABLE 4

| Specific Gravity (15/4° C.) | Dynamic Viscosity (50° C.) | Water Content (wt %) |
|---|---|---|
| 0.9490 | 180 (cst.) | 0.1 or less |

TABLE 5

| No. | Type of Coal | Drying Method | Median Diameter of Coal Grain*1 | Median Diameter (microns) | Modal Diameter (microns) | Absolute Value of Difference Median Diameter and Modal Diameter (microns) | Water Content (wt %) | Viscosity (poises/ 70° C.) | Static Stability (%) |
|---|---|---|---|---|---|---|---|---|---|
| Example 7 | II | hot air | 15μ/7μ = 6/4 | 12.2 | 14.4 | 2.2 | 0.3 | 39 | 50.3 |
| Example 8 | II | hot air | 21μ/7μ = 6/4 | 14.9 | 19.8 | 4.9 | 0.1 | 35 | 50.3 |
| Example 9 | II | hot air | 21μ/7μ = 7/3 | 14.9 | 17.0 | 2.1 | 0.1 | 40 | 51.2 |
| Example 10 | II | hot air | 17μ/7μ = 5/5 | 12.5 | 16.0 | 3.5 | 0.1 | 40 | 50.0 |
| Example 11 | II | hot air | 17μ/7μ = 6/4 | 13.5 | 16.5 | 3.0 | 0.1 | 36 | 50.1 |
| Example 12 | II | hot air | 17μ/7μ = 8/2 | 11.8 | 14.3 | 2.5 | 0.1 | 45 | 50.5 |
| Example 13 | II | dry air | 15μ/7μ = 6/4 | 12.2 | 14.4 | 2.2 | 3.5 | 75 | 50.0 |
| Example 14 | II | dry air | 21μ/7μ = 6/4 | 14.9 | 19.8 | 4.9 | 3.5 | 117 | 50.3 |
| Comparative Example 9 | II | dry air | 10μ | 9.7 | 9.0 | 0.7 | 0.1 | 144 | 50.1 |
| Comparative Example 10 | I | dry air | 21μ | 20.5 | 20.0 | 0.5 | 3.5 | 140 | 58.0 |
| Comparative Example 11 | I | hot air | 21μ | 20.5 | 20.0 | 0.5 | 0.3 | 46 | 68.0 |
| Comparative Example 12 | II | hot air | 60μ/3μ = 6/4 | 38.0 | 55.0 | 17.0 | 0.1 | 25 | 60.0 |

*1 xμ/yμ = α/β indicates that coal grain having a median diameter of x microns and coal grain having a median diameter of y microns are mixed in a ratio of α/β (by weight).

We claim:

1. A mixed fuel of coal dispersed in oil which comprises from 40 to 60 percent by weight of finely ground coal and from 60 to 40 percent by weight of a hydrocarbon oil, said finely ground coal being a mixture of (A) coal grains having a median diameter of 10 microns or less and (B) coal grains having a median diameter of from 15 to 42 microns in a ratio A/B of from 8/2 to 1/9; and the absolute value of the difference between the median diameter and the modal diameter of the coal grains in said mixture being at least 2 microns.

2. The mixed fuel of claim 1, which has a water content of 0.6 percent by weight or less.

3. The mixed fuel of claim 2, wherein said mixture of coal grains (A) has a median diameter of from 5 to 10 microns.

4. The mixed fuel of claim 1, wherein said mixture of coal grains (A) has a median diameter of from 5 to 10 microns.

5. The mixed fuel of any one of claims 1, 2, 3 or 4 wherein said ratio is from 7/3 to 2/8.

6. The mixed fuel of claims 1, 2, 3 or 4, wherein said coal comprises between 45 and 55 percent by weight based on the total weight of said mixed fuel.

7. The mixed fuel of claim 5, wherein said coal comprises between 45 and 55 percent by weight based on the total weight of said mixed fuel.

8. The mixed fuel of claims 1, 2, 3 or 4, wherein said mixture of coal grains (B) has a median diameter of from 15 to 30 microns.

9. The mixed fuel of claim 7, wherein said mixture of coal grains (B) has a median diameter of from 15 to 30 microns.

10. The mixed fuel of claim 9, wherein said hydrocarbon oil is an oil obtained from petroleum or coal.

11. The mixed fuel of claim 1, wherein said hydrocarbon oil is an oil obtained from petroleum or coal.

* * * * *